US010744770B2

(12) United States Patent
Toshishige et al.

(10) Patent No.: US 10,744,770 B2
(45) Date of Patent: Aug. 18, 2020

(54) LIQUID EJECTION HEAD AND METHOD OF MANUFACTURING SAME

(71) Applicant: CANON KABUSHIKI KAISHA, Tokyo (JP)

(72) Inventors: Mitsunori Toshishige, Kawasaki (JP); Kenji Takahashi, Yokohama (JP); Shiro Sujaku, Kawasaki (JP); Daisuke Otsuka, Kawasaki (JP)

(73) Assignee: Canon Kabushiki Kaisha, Tokyo (JP)

( * ) Notice: Subject to any disclaimer, the term of this patent is extended or adjusted under 35 U.S.C. 154(b) by 0 days.

(21) Appl. No.: 16/457,527

(22) Filed: Jun. 28, 2019

(65) Prior Publication Data

US 2020/0009863 A1 Jan. 9, 2020

(30) Foreign Application Priority Data

Jul. 3, 2018 (JP) ..... 2018-126575

(51) Int. Cl.
*B41J 2/14* (2006.01)
*B41J 2/16* (2006.01)

(52) U.S. Cl.
CPC ..... *B41J 2/1433* (2013.01); *B41J 2/162* (2013.01); *B41J 2/1637* (2013.01)

(58) Field of Classification Search
CPC ..... B41J 2/1433; B41J 2/1637; B41J 2/162; B41J 2/1631; B41J 2/1629; B41J 2/1628; B41J 2/14145; B41J 2/1603
See application file for complete search history.

(56) References Cited

U.S. PATENT DOCUMENTS

2008/0001994 A1* 1/2008 Kaneko ..... B41J 2/1404 347/40
2015/0343781 A1* 12/2015 Hamada ..... B41J 2/14145 347/65

FOREIGN PATENT DOCUMENTS

JP 2012158150 A 8/2012
JP 5737973 B2 * 6/2015 ..... B41J 2/14

OTHER PUBLICATIONS

Machine translation of JP 2012-158150, published Aug. 2012 (Year: 2012).*
Machine translation of JP-5737973B2, published on Jun. 2015 (Year: 2015).*

* cited by examiner

*Primary Examiner* — Huan H Tran
(74) *Attorney, Agent, or Firm* — Canon U.S.A., Inc. IP Division

(57) ABSTRACT

A liquid ejection head is equipped with a substrate having therethrough a supply path to be supplied with a liquid, a top plate placed opposite to the substrate, having an ejection orifice for ejecting the liquid and constituting, between the top plate and the substrate, a flow path communicated with the supply path and the ejection orifice and a columnar member extending from the top plate to the inside of the supply path through the flow path. An end surface of the columnar member positioned in the supply path is tilted relative to the top plate in a direction away from the ejection orifice.

16 Claims, 5 Drawing Sheets

LIQUID EJECTION HEAD AND METHOD OF MANUFACTURING SAME

BACKGROUND OF THE DISCLOSURE

Field of the Disclosure

The present disclosure relates to a liquid ejection head and a method of manufacturing the same.

Description of the Related Art

A liquid ejection head for ejecting a liquid such as ink is sometimes provided with a member for trapping a foreign matter contained in the liquid in order to improve a recording quality. As such a liquid ejection head, Japanese Patent Application Laid-Open No. 2012-158150 discloses a liquid ejection head having a substrate having therethrough a supply path for supplying a liquid therefrom, a flow path forming member placed opposite to the substrate and a filter. In the liquid ejection head described in Japanese Patent Application Laid-Open No. 2012-158150, the flow path forming member has a top plate equipped with an ejection orifice for ejecting the liquid and the top plate constitutes, together with the substrate, a flow path communicated with the supply path and the ejection orifice. It further has a columnar member extending from the top plate to the inside of the supply path through the flow path. This columnar member functions as a filter for trapping a foreign matter contained in the liquid.

In the liquid ejection head described in Japanese Patent Application Laid-Open No. 2012-158150, an end surface of the columnar member present in the supply path, that is, an end surface of the columnar member on the upstream side in a liquid supply direction is flat. The columnar member having such a shape cannot control, at the end surface thereof, the moving direction of the foreign matter so that the foreign matter may flow into the vicinity of the ejection orifice. If a foreign matter flows into the vicinity of an ejection orifice of a recent liquid ejection head required to satisfy both high-speed and high-precision recording, it may impede the supply of a liquid quantity necessary for the formation of a liquid droplet and deteriorate a recording quality.

SUMMARY OF THE DISCLOSURE

A liquid ejection head of the disclosure has a substrate having therethrough a supply path to be supplied with a liquid, a top plate placed opposite to the substrate, equipped with an ejection orifice for ejecting the liquid and constituting, between the top plate and the substrate, a flow path communicated with the supply path and the ejection orifice and a columnar member extending from the top plate to the inside of the supply path through the flow path. An end surface of the columnar member positioned in the supply path is tilted relative to the top plate in a direction away from the ejection orifice.

Further features and aspects of the present disclosure will become apparent from the following description of example embodiments with reference to the attached drawings.

DESCRIPTION OF THE EMBODIMENTS

Several example embodiments of the disclosure and various features thereof will hereinafter be described referring to some drawings. A liquid ejected from the liquid ejection head of the disclosure is not particularly limited but in the present embodiments, the liquid will be described as an ink.

Figure 1A:
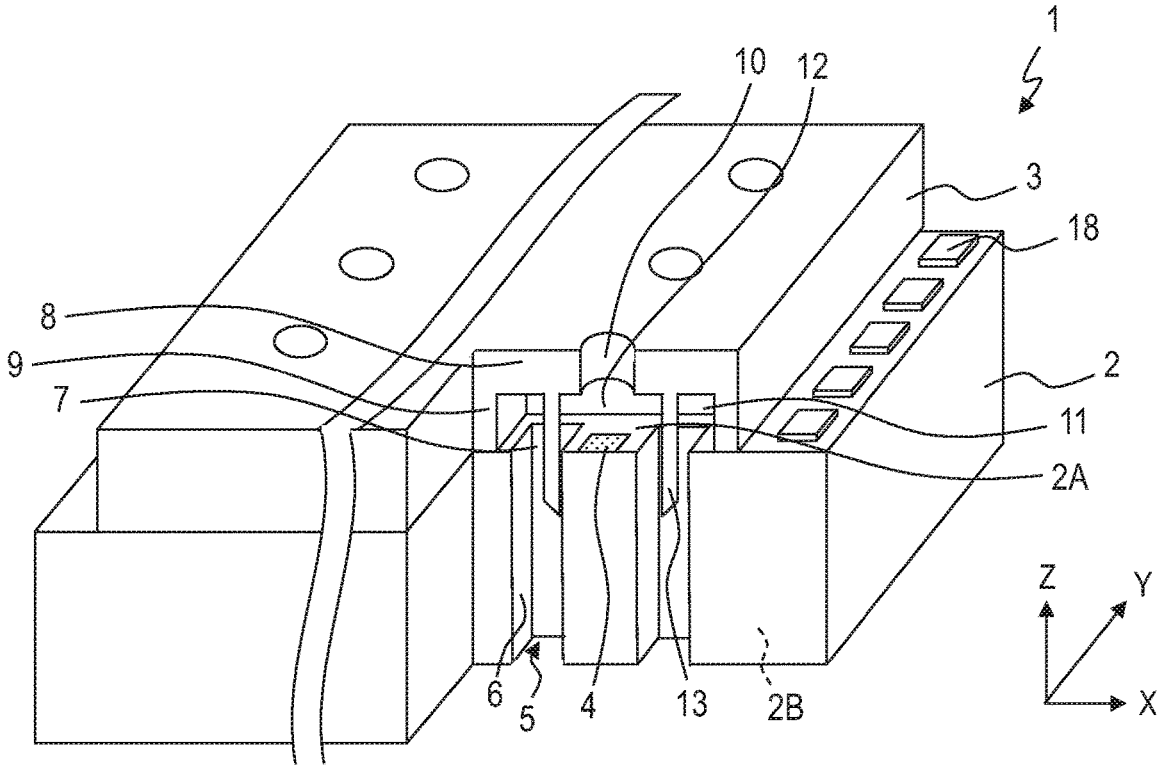
FIGS. 1A and 1B are each a schematic view of a liquid ejection head according to an example embodiment of the disclosure.
Figure 1B:
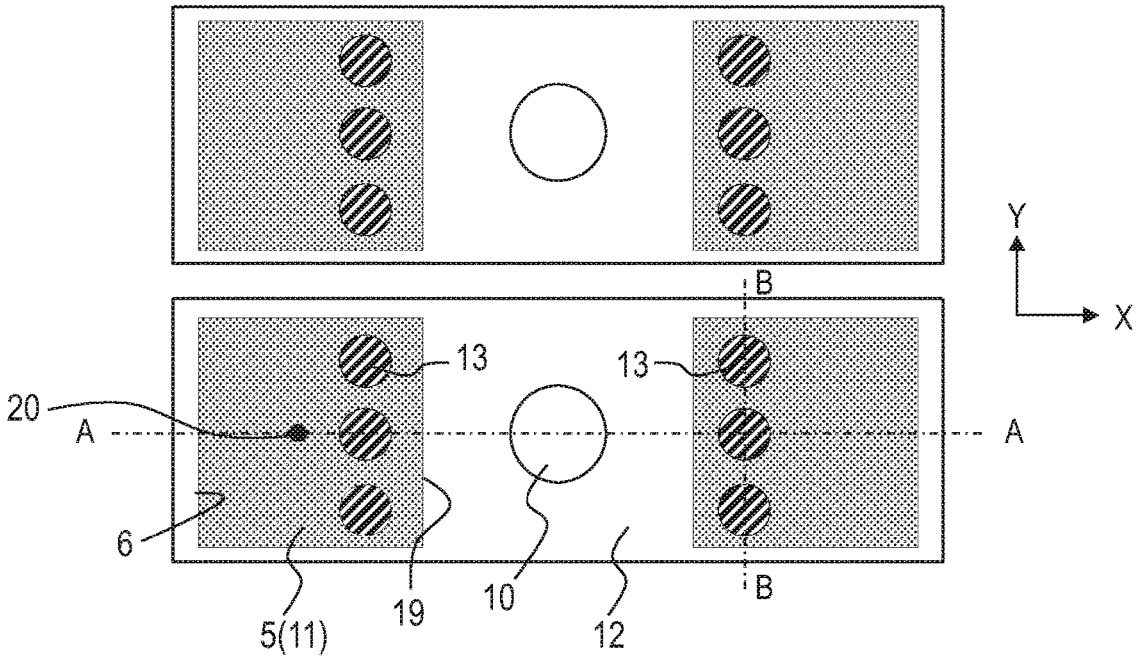
Figure 2A:
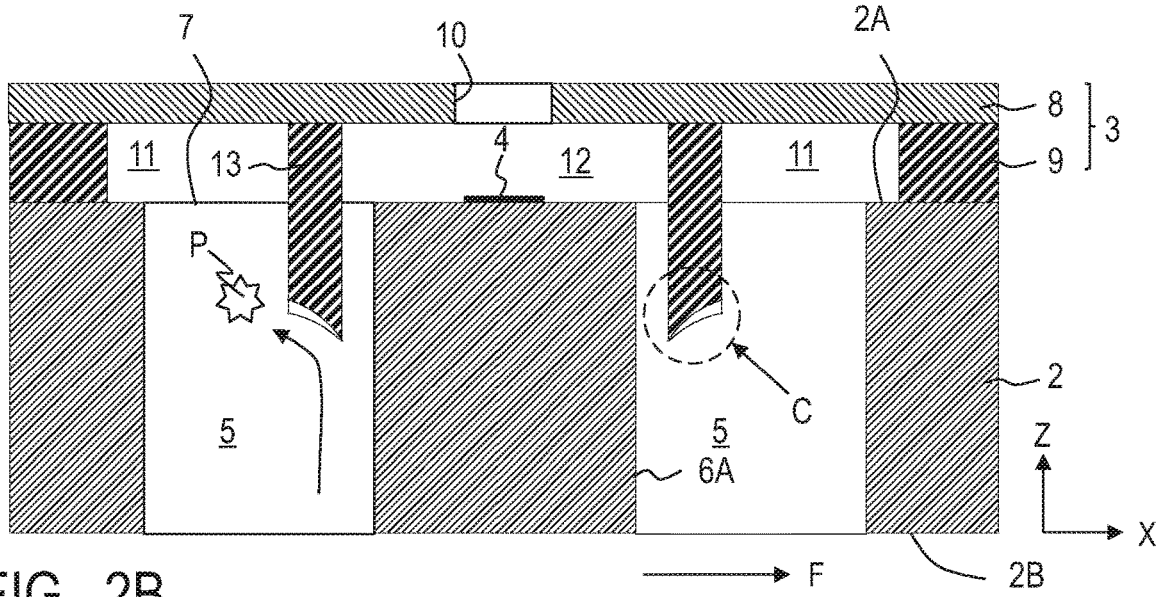
FIGS. 2A, 2B and 2C are each a schematic cross-sectional view of the liquid ejection head shown in FIGS. 1A and 1B.
Figure 2B:
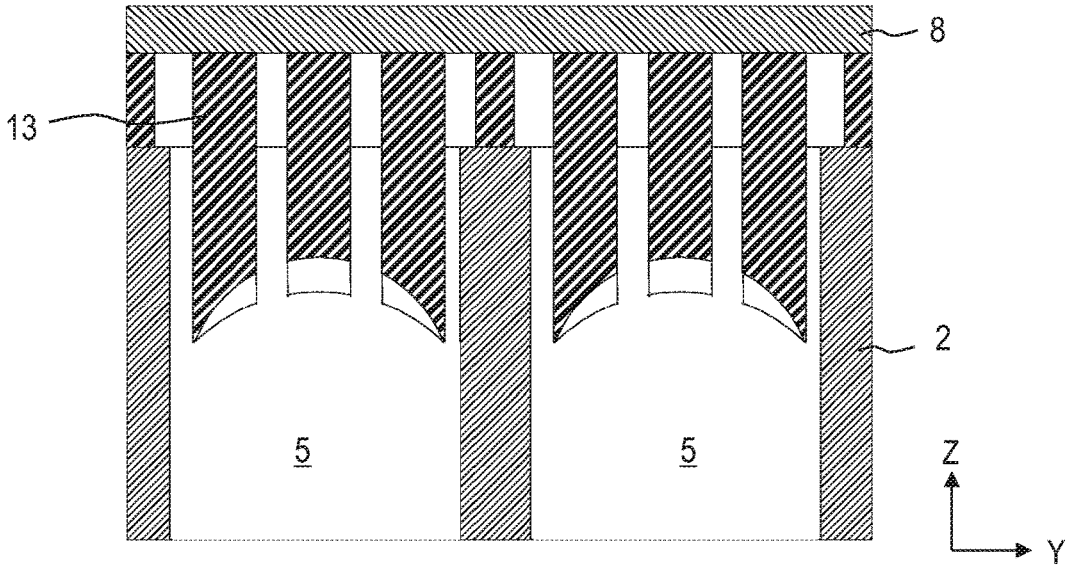
Figure 2C:
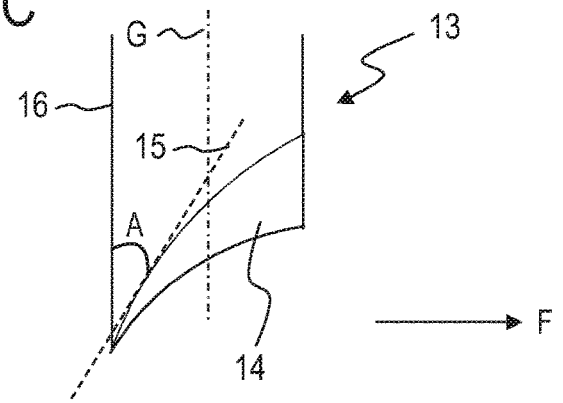

FIG. 1A is a perspective view schematically showing the liquid ejection head according to an example embodiment of the disclosure. FIG. 1B is a plan view of the liquid ejection head shown in FIG. 1A and for the convenience sake, it shows an ejection orifice, a supply path and a columnar member on the same plane. FIG. 2A shows a cross-section taken along the line A-A in FIG. 1B, FIG. 2B shows a cross-section along the line B-B in FIG. 1B and FIG. 2C is an enlarged view of the portion C in FIG. 2A. In each drawing, the direction X is a direction of an ink flowing into a pressure chamber 12, the direction Y is orthogonal to the direction X and is an arranging direction of a plurality of ejection orifices 10 and the direction Z is orthogonal to the directions X and Y and is an ejecting direction of an ink from each of the ejection orifices 10.

The liquid ejection head 1 has a substrate 2 and a flow path forming member 3 formed on the substrate 2. The substrate 2 has an energy-generating element 4 for applying ink ejection energy to an ink, a drive circuit (not shown) of the energy-generating element 4, a connection terminal 18 and the like. Examples of the energy-generating element 4 include a heat generating resistive element using a TaSiN film. The number of the energy-generating element 4 is not limited and two or more energy-generating elements 4 may be placed at predetermined intervals. The substrate 2 may have thereon an insulating layer, a protective layer, an adhesion improving layer, a planarizing layer, an anti-reflection layer, a chemical resistant layer or the like (these layers are not shown). These layers may each be formed between any two layers. The drive circuit includes a semiconductor element such as transistor. Although the substrate 2 is not particularly limited insofar as a semiconductor element or circuit may be formed thereon, a silicon substrate is preferred from the standpoint of control of a resistivity or processability. In the following description, the surface of the substrate 2 having thereon the energy-generating element 4, drive circuit, connection terminal 18 and the like will be called "first surface 2A", while the rear surface of the first surface 2A will be called "second surface 2B".

The substrate 2 has a supply path 5 for supplying an ink therefrom and the supply path penetrates the substrate 2 from the first surface 2A to the second surface 2B. The supply path 5 is formed on both sides of the energy-generating element 4 in the direction X, but it may be formed only on one side. By using the supply path 5 and the like, a liquid in the pressure chamber 12 is preferably circuited between the chamber and the outside. The supply path 5 has a substantially rectangular flow-path cross-section. As will be described later, it is important, in a manufacturing step of the liquid ejection head 1, to cause a resin to sag stably from the first surface 2A into the supply path 5 so that all of the four wall surfaces 6 of the supply path 5 are perpendicular to the first surface 2A of the substrate 2. When the wall surface 6 of the supply path 5 has a shape not perpendicular to the first surface 2A, sufficient sagging of the resin may not be achieved partially. In the following description, a surface that opens in the first surface 2A of the supply path 5 will be called "first opening 7".

The flow path forming member 3 has a top plate 8 placed opposite to the substrate 2 and a side wall 9 positioned between the top plate 8 and the substrate 2. The top plate 8 is equipped with an ejection orifice 10 for ejecting an ink. The top plate 8 constitutes, between the top plate and the substrate 2, a flow path 11 and the pressure chamber 12. The top plate 8 has a film thickness of preferably from 0.5 μm or more to 100 μm or less. The pressure chamber 12 is equipped with the energy-generating element 4 and the energy-generating element 4 is placed opposite to the ejection orifice 10. The flow path 11 is communicated with the supply path 5 and the pressure chamber 12. Accordingly, the flow path 11 is also communicated with the ejection orifice 10. The ink supplied from the outside of the liquid ejection head 1 travels in the supply path 5 and the flow path 11 and then is supplied into the pressure chamber 12. Then, by the energy for ejection given from the energy-generating element 4 which the pressure chamber 12 has inside thereof, the ink is ejected from the ejection orifice 10.

The liquid ejection head 1 further has a columnar member 13 that extends from the top plate 8 to the inside of the supply path 5 through the flow path 11. The columnar member 13 is on the upstream side of the pressure chamber 12 in the ink flow direction and it functions as a filter for trapping a foreign matter contained in the ink. Each supply path 5 has therein at least one columnar member 13, preferably a plurality of columnar members 13. By providing one supply path 5 with a plurality of columnar members 13, improvement in foreign matter-trapping performance can be achieved. To smoothly supply the ink to the pressure chamber 12, the columnar member 13 is preferably cylindrical, because the cylindrical shape reduces flow resistance. Although the diameter, arrangement, number and interval of the columnar member 13 can be determined as needed depending on the size or shape of a foreign matter to be trapped, the columnar member 13 is placed as close as possible to an edge portion 19, on the side of the ejection orifice 10, of the first opening 7 of the supply path 5. In other words, the columnar member 13 is placed preferably at a position on the side of the ejection orifice 10 relative to a center 20 of the flow path cross-section of the supply path 5. One end of the columnar member 13 is fixed to the top plate 8 at a position opposite to the supply path 5 and the other end is a free end positioned in the supply path 5.

An end surface 14 of the free end, that is, a surface of the columnar member 13 on the rear side viewed from the top plate 8, is tilted relative to the top plate 8 in a direction away from the ejection orifice 10. The direction away from the ejection orifice 10 is indicated by a symbol F in FIGS. 2A and 2C. As shown in FIG. 2A, therefore, a foreign matter P is guided in a direction away from the ejection orifice 10 along the tilt of the end surface 14 of the columnar member 13 and is trapped at a position, in the supply path 5, having less influence on the ink ejection. The end surface 14 of the columnar member 13 has a concave surface which is concave toward a wall surface 6A of the supply path 5 proximate to the columnar member 13 and it has an edged tip portion. In other words, a tilt angle A of the end surface 14 becomes smaller with an increase in the distance from the center 20 of the flow path cross-section of the supply path 5. The term "tilt angle A" of the end surface 14 is an angle, in the cross-section passing a longitudinal axis G of the columnar member 13, between a tangent 15 drawn to the curved end surface 14 and the longitudinal axis G of the columnar member 13 or a side surface 16 parallel to the longitudinal axis G. The tilt angle A of the end surface 14 is less than 90 degrees at any position of the end surface 14. When the tilt angle A is 90 degrees, the end surface 14 of the columnar member 13 is flat or has a structure analogous thereto so that an effect of guiding the foreign matter to a direction away from the ejection orifice 10 cannot be expected. When the angle is more than 90 degrees, on the contrary, the foreign matter is likely to be guided to a direction close to the side of the ejection orifice 10. As will be described later, however, the shape of the end surface 14 of the columnar member 13 depends on the shape of a sagging portion 24 of a resin formed in the supply path 5 during a manufacturing step. When a plurality of columnar members 13 is formed in the supply path 5, therefore, the columnar members 13 may differ in the tilt angle A of the end surface 14, depending on the position of the columnar members 13 in the supply path 5.

A side wall 9 of the flow path forming member 3 and the columnar member 13 are formed using a common mold so that they are made of the same material. Although these members are each made of a positive photosensitive resin or a negative photosensitive resin, they are made of preferably a negative photosensitive resin from the standpoint of light resistance or patterning property. In consideration of the degree of freedom of a manufacturing step or reliability of the product, a resin having high resistance to heat or a chemical is preferred. Examples of such a resin include polyimide resins, polyamide resins, epoxy resins, polycarbonate resins, acrylic resins and fluoro resins. As the resin, these photosensitive resins may be used either singly or in combination of two or more thereof. The photosensitive resin may contain a photoacid generator, a sensitizing agent, a reducing agent, an adhesion improving additive, a water repellent, an electromagnetic wave absorbing member or the like. The photosensitive resin may be a mixture with a thermoplastic resin, a softening point-control resin, a strength enhancing resin, or the like. The top plate 8 of the flow path forming member 3 is preferably made of the negative photosensitive resin because of reasons similar to those described above and the above description in this paragraph also applies to the top plate 8.

Figure 3A:
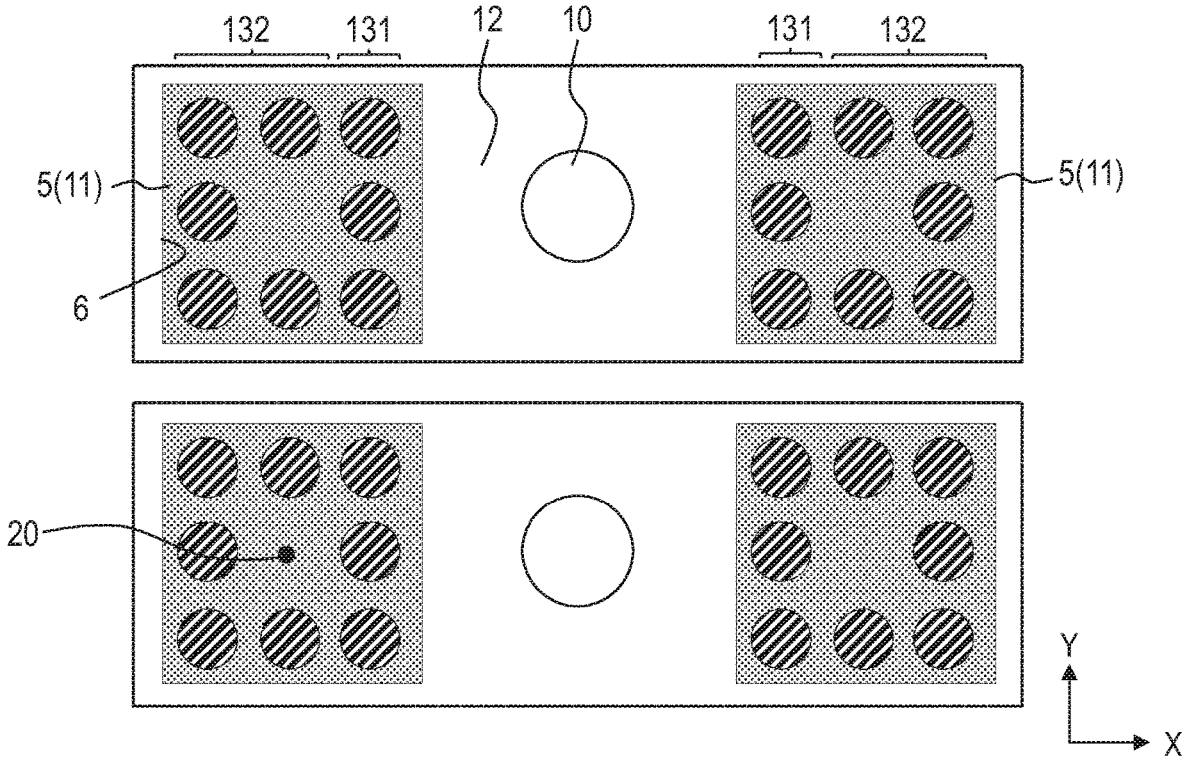
FIGS. 3A and 3B are each a schematic plan view of a liquid ejection head of a modification example.
Figure 3B:
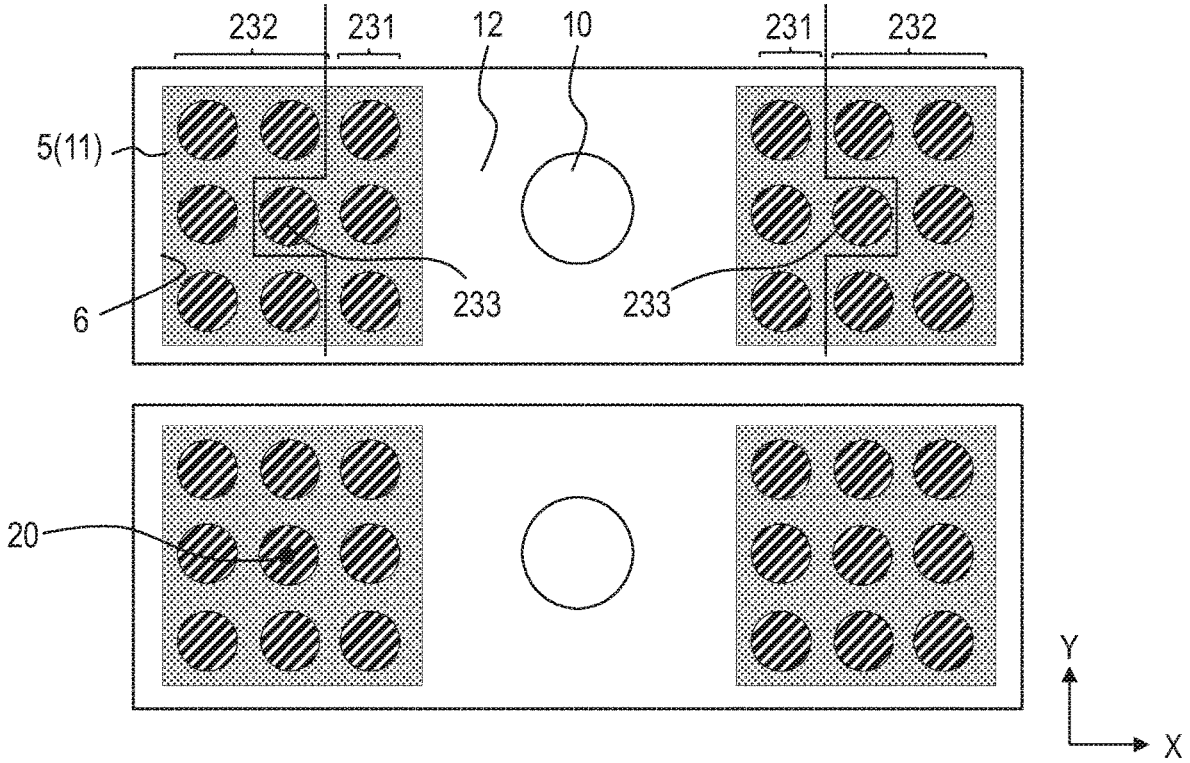

FIGS. 3A and 3B are views similar to FIG. 1B and show modification examples of the present embodiment, respectively. Referring to FIG. 3A, a plurality of first columnar members 131 and a plurality of second columnar members (other columnar members) 132 are placed along the wall surface 6 of the supply path 5. The number of the columnar members 131 and 132 is larger than that of the embodiment shown in FIGS. 1A and 1B so that improvement in foreign matter-trapping performance is achieved in the supply path 5 and the flow path 11. The respective end surfaces 14 of the first columnar members 131 and the second columnar members 132 are tilted relative to the top plate 8 in a direction facing the center 20 of the flow path cross-section of the supply path 5. In other words, the respective tilted end surfaces 14 of the first columnar members 131 and the second columnar members 132 all face the center 20 of the flow path cross-section of the supply path 5. The first columnar members 131 have the constitution equal to that of the columnar member 13 of the embodiment shown in FIGS.

1A and 1B and FIGS. 2A, 2B and 2C and the end surface 14 of the free end is tilted relative to the top plate 8 in a direction away from the ejection orifice 10. This makes it possible to guide a foreign matter in a direction away from the ejection orifice 10 and at the same time, guide it to the center 20 of the flow path cross-section of the supply path 5, leading to a reduction in the possibility of the foreign matter flowing into the pressure chamber 12 and a further improvement in the recording quality.

Referring to FIG. 3B, a plurality of first columnar members 231, a plurality of second columnar members (other columnar members) 232 and a central third columnar member (a further columnar member) 233 are provided. These columnar members 231, 232 and 233 are placed at equal intervals in two directions (directions X and Y) orthogonal to each other. In the example shown in this drawing, the number of the third columnar member 233 is one, but a plurality of third columnar members 233 may be provided. The number of the columnar members 231, 232 and 233 is larger than those of the modification example shown in FIG. 3A and all the columnar members 231, 232 and 233 are placed at equal intervals. This makes it possible to reduce the possibility of a foreign matter larger than a space between any two of the columnar members 231, 232 and 233 flowing into the pressure chamber 12 and thereby improve the recording quality further. The first columnar members 231 have a constitution similar to that of the columnar members 13 and 131 in the above embodiments, while the second columnar members 232 have a constitution similar to that of the columnar members 132 in the above embodiment. This means that the present modification example has, in addition to the constitution of the modification example shown in FIG. 3A, the third columnar member 233. The end surface 14 of the third columnar member 233 placed at the center 20 of the flow path cross-section of the supply path 5 becomes substantially horizontal. These modification examples can be manufactured only by changing an exposure pattern of the columnar members in the manufacturing method described later.

Figure 4:
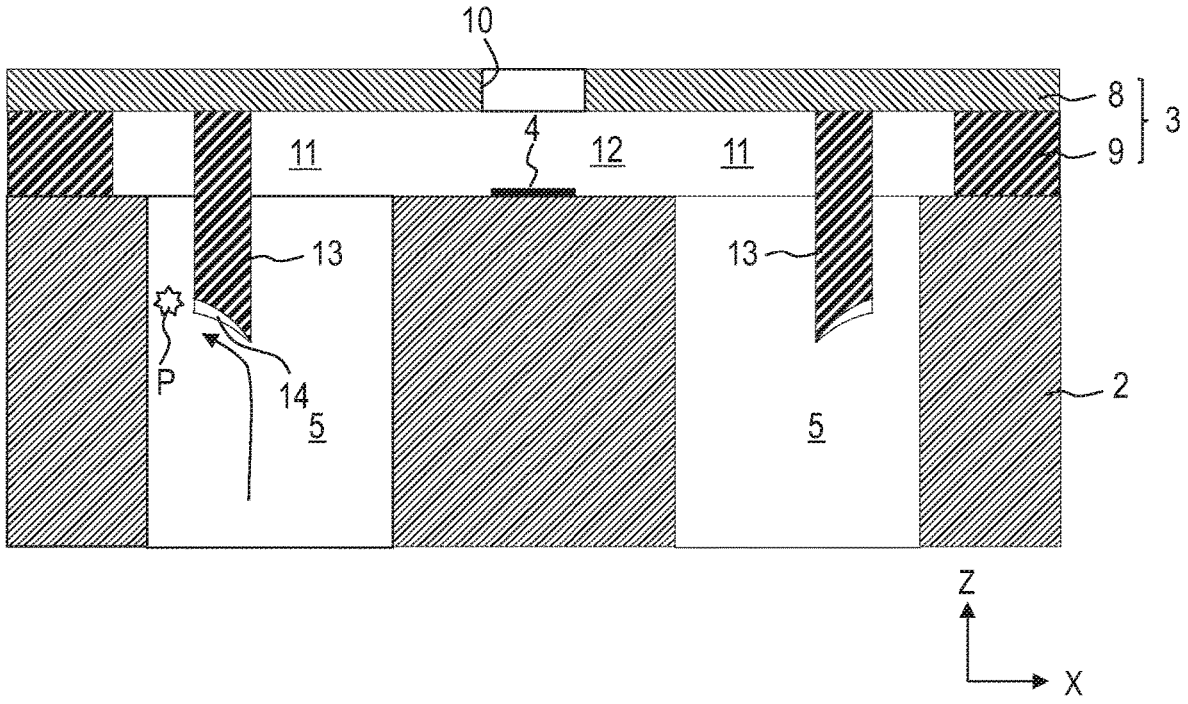
FIG. 4 is a schematic cross-sectional view of a liquid ejection head of another modification example.

FIG. 4 shows a further modification example of the present embodiment and is a view similar to FIG. 2A. In this example, the columnar member 13 is placed at a position more distant from the ejection orifice 10 than that of the embodiment shown in FIG. 2A. Also in the present example, the end surface 14 of the columnar member 13 is tilted relative to the top plate 8 in a direction away from the ejection orifice 10 so that flow of a foreign matter into the pressure chamber 12 or the ejection orifice 10 can be suppressed. From the standpoint of productivity, however, the embodiment shown in FIG. 2A is preferred because of easy patterning.

One example of a method of manufacturing the liquid ejection head 1 described above will next be described referring to FIGS. 5A to 5I while showing a specific example as Example. FIGS. 5A to 51 are each a view showing a partial cross-section of FIG. 1A in the direction X.

Figure 5A:
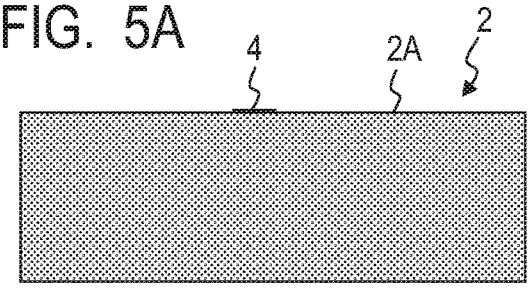
FIGS. 5A, 5B, 5C, 5D, 5E, 5F, 5G, 5H and 5I are each a schematic view showing another example of a method of manufacturing the liquid ejection head shown in FIGS. 1A and 1B.

First, as shown in FIG. 5A, an energy-generating element 4 using a TaSiN film, a protective film (not shown) made of SiN, a drive circuit (not shown) for the energy-generating element 4, a connection terminal (not shown) and the like are formed on a first surface 2A of a substrate 2. As the substrate 2, a silicon (100) substrate is used.

Figure 5B:
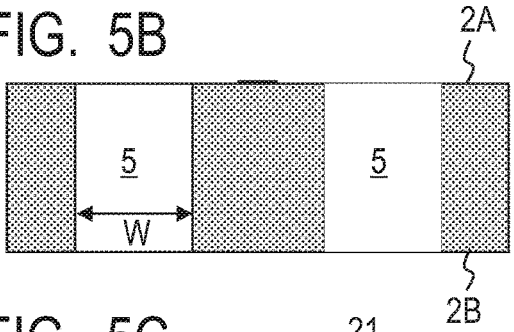

Next, as shown in FIG. 5B, a supply path 5 of an ink penetrating the substrate 2 from the first surface 2A to a second surface 2B is formed in the substrate 2. The supply path 5 can be formed by a method such as laser processing, reactive ion etching, sand blasting or wet etching. The supply path 5 can be formed by using a plurality of methods in combination or the supply path 5 may be formed in stages over a plurality of manufacturing steps. In Example, the supply path 5 was formed by reactive ion etching so as to form a wall surface 6 perpendicular to the first surface 2A of the substrate 2. The supply path 5 in Example had an opening width W of 50 μm.

Figure 5C:
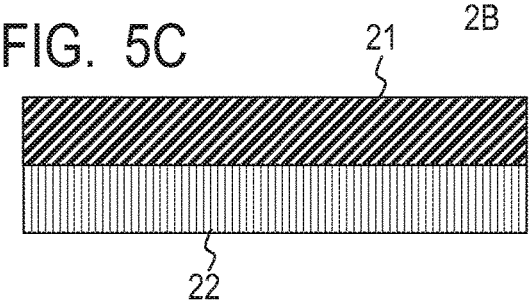

Next, as shown in FIG. 5C, a first dry film 21 supported by a first support 22 and made of a negative photosensitive resin is provided. The first dry film 21 is used as a mold 23 for the formation of a flow path 11 and a pressure chamber 12 and at the same time, a remaining portion, that is, a portion becoming insoluble by exposure to light becomes a side wall 9 of a flow path forming member 3 and a columnar member 13. A surface of the first support 22 on which the first dry film 21 is formed is subjected to mold release treatment. In Example, after a solution obtained by dissolving an epoxy resin and a photoacid generator in PGMEA (propylene glycol methyl ether acetate) was applied to the surface of the first support 22 subjected to mold release treatment, heat treatment was performed at 100° C. to form the first dry film 21. As the epoxy resin, "N-695", trade name; product of Dainippon Ink and Chemicals was used and as the photoacid generator, "CPI-210S", trade name; product of San-Apro was used. As the first support 22, a 100-μm thick single-layer film made of PET was used.

Figure 5D:
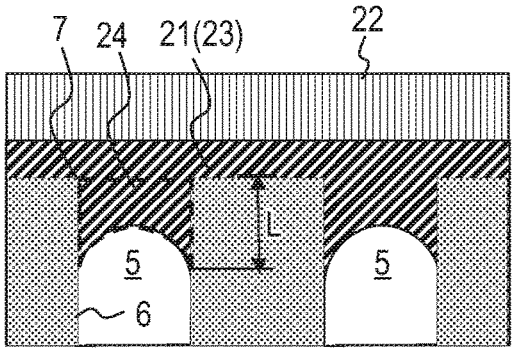

Next, as shown in FIG. 5D, a mold 23 is formed on the first surface 2A of the substrate 2. In Example, the first dry film 21 supported by the first support 22 was transferred to the first surface 2A of the substrate 2 by using a roll type laminating machine ("VTM-200", trade name; product of Takatori). The transfer was performed under the following conditions: a transfer temperature of 90° C., a roller speed of 0.1 mm/sec and a roller pressure of 0.4 MPa. The first dry film 21 serving as the mold 23 is transferred at a temperature equal to or more than the softening point of the first dry film 21 and at the same time, is pressed with a roller so that a portion of it sags from the first opening 7 into the supply path 5 along the wall surface 6 of the supply path 5. The term "sag" means a phenomenon in which the first dry film 21 moves down along the wall surface 6 of the supply path 5. A phenomenon in which a portion separated from the first dry film 21 drops in the supply path 5 does not substantially occur. As a result, a sagging portion 24 of the mold 23 is formed in the supply path 5. The sagging portion 24 fills a portion of the supply path 5 on the side of the first surface 2A and at the same time, fills therewith at least the first opening 7 of the supply path 5. When the supply path 5 is viewed from the first surface 2A toward the second surface 2B, therefore, the supply path 5 has, at any position thereof, the mold 23. Since the mold 23 drops along the wall surface 6 of the supply path 5, a sagging length L is the largest on the wall surface 6 and at the same time, the mold closer to the wall surface 6 sags more deeply. In addition, sagging occurs almost uniformly over all the directions around the center 20 of the flow path cross-section of the supply path 5. As a result, the sagging portion 24 has, at an apical surface thereof, a bowl-shaped concave surface or a parabolic surface when viewed from the direction X or direction Y. The film thickness of the mold 23 formed on the first surface 2A is preferably 0.5 μm or more to 100 μm or less. In Example, the film thickness of the mold 23 formed on the first surface 2A was 30 μm and the sagging length L of the mold 23 on the wall surface 6 of the supply path 5 was 30 μm.

A portion of the sagging portion 24 becomes a columnar member 13 by exposure and development so that it is important to cause the mold 23 to sag intentionally and stably into the supply path 5. It is therefore preferred to, while softening the first dry film 21 made of a resin which will be the mold 23 at a temperature equal to or more than the softening point of the mold 23 via the first support 22, transfer it to the first surface 2A of the substrate 2 at an appropriate roller speed and roller pressure. For acceleration of the sagging of the mold 23, an increase in the transfer temperature, retardation of the roller speed or an increase in the roller pressure is recommended. These transfer conditions are selected in consideration of the mold 23 used, the structure of the liquid ejection head 1 or the like. The mold 23 can also be formed by the method of application such as curtain coating or roll coating.

Figure 5E:
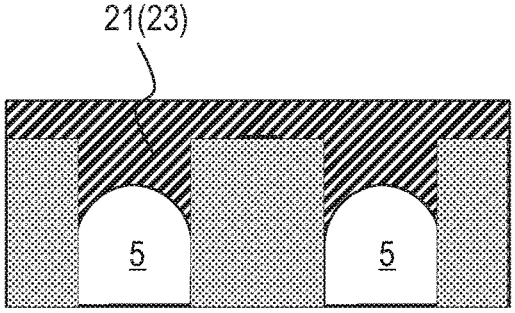

Next, as shown in FIG. 5E, the first support 22 is released from the first dry film 21. In Example, releasing was performed under the environment of 25° C.

Figure 5F:
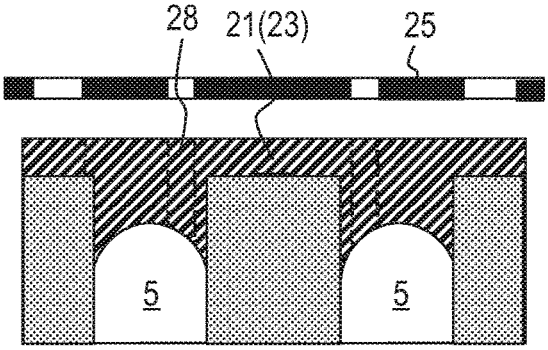

Next, as shown in FIG. 5F, the mold 23 is exposed to light with a predetermined pattern. When a negative photosensitive resin is used, a latent image 28 of the pattern of the columnar member 13 is formed on the mold 23. When a positive photosensitive resin is used, a latent image of the pattern of each of the flow path 11 and the pressure chamber 12 is formed on the mold 23. In order to suppress deformation of the pattern, absence of a reflective substance in the supply path 5 and at a periphery thereof is preferred. The mold 23 (first dry film 21) preferably has selectivity for sensitivity or exposure wavelength so as to prevent it from being sensitized upon exposure for forming an ejection orifice 10 in a top plate 8 in a later step. In the present embodiment, the latent image of the pattern of the columnar member 13 is formed prior to the formation of the top plate 8, but it may be formed after formation of the top plate 8. Since a portion of the mold 23 having thereon the latent image 28 of the columnar member 13 is not directly supported by the substrate 2, development at this stage may inevitably cause outflow of it together with the respective portions of the mold 23 which will become the flow path 11 and the pressure chamber 12. Development of the mold 23 is therefore not performed at this time. In Example, by using a lithography equipment ("FPA-5510iV", trade name; product of Canon), the mold 23 was exposed to light through a first mask 25 under the following exposure conditions: wavelength of light at 365 nm and exposure dose of 10000 J/m$^2$. Then, heat treatment was performed at 90° C. for 5 minutes to form the latent image 28 of the pattern of the columnar member 13.

Figure 5G:
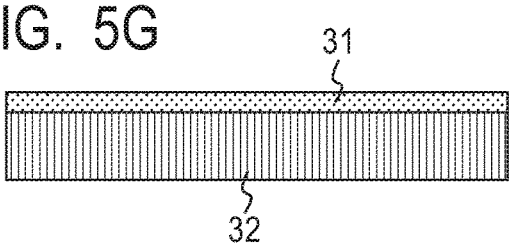

Next, as shown in FIG. 5G, a second dry film 31 supported by a second support 32 and made of a negative photosensitive resin is provided. The surface of the second support 32 on which the second dry film 31 is to be formed is subjected to mold release treatment. In Example, after application of a solution obtained by dissolving an epoxy resin and a photoacid generator in PGMEA to the surface of the second support 32 subjected to mold release treatment, heat treatment was performed at 80° C. to form the second dry film 31. As the epoxy resin, "157S70", trade name; product of Japan Epoxy Resin was used and as the photoacid generator, "LW-S1", trade name; product of San-Apro was used. The second dry film 31 was formulated so as to have exposure sensitivity higher than that of the first dry film 21.

Figure 5H:
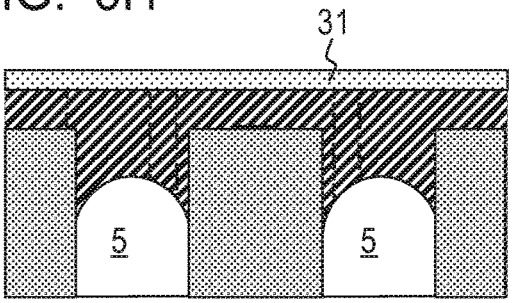

Next, as shown in FIG. 5H, the second dry film 31, that is, a photosensitive resin layer which will be the top plate 8 is transferred to the mold 23. Since a dry film is used for the formation of the top plate 8, softening and dissolution of the mold 23 can be suppressed. The second dry film 31 is bonded to the mold 23 with adhesive force enough to prevent the portion of the columnar member 13 having the latent image 28 of the pattern formed thereon from being released in a later development step. In Example, the second dry film 31 supported by the second support 32 was transferred onto the mold 23 by using a roll type laminator ("VTM-200", trade name; product of Takatori). The transfer was performed under the following conditions: a transfer temperature of 50° C., a roller speed of 10.0 mm/sec and a roller pressure of 0.2 MPa. The second dry film 31 formed on the mold 23 had a film thickness of 15 μm. Then, the second support 32 was released from the second dry film 31 in an environment of 25° C.

Figure 5I:
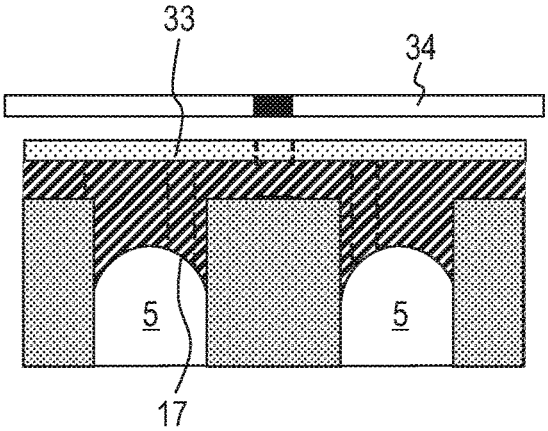

Next, as shown in FIG. 5I, the second dry film 31 is exposed to light with a predetermined pattern to form a latent image 33 of a pattern of a portion other than the ejection orifice 10. In Example, by using a lithography equipment ("FPA-5510iV", trade name; product of Canon), the second dry film 21 was exposed to light through a second mask 34 under the following exposure conditions: wavelength of light at 365 nm and exposure dose of 1000 J/m$^2$, followed by heat treatment at 90° C. for 5 minutes to form a latent image 33. The latent image is then immersed in PGMEA for development. From the latent image 28 of the pattern of the columnar member 13, the columnar member 13 is formed and from the latent image 33, the ejection orifice 10 is formed. The end surface 14 of the columnar member 13 positioned in the supply path 5 becomes a shape along a bowl-shaped virtual surface 17 protruding toward the top plate 8 at a center 20 of the flow path cross-section of the supply path 5. Heat treatment is then performed to cure the mold 23 and the second dry film 31. In Example, heat treatment was performed at 200° C. for 60 minutes. Electrical connection is performed lastly to complete the liquid ejection head 1. As a developing solution for the mold 23 and the second dry film 31, cyclohexanone, methyl ethyl ketone, xylene or the like as well as the above-described PGMEA can be used. When the mold 23 and the second dry film 31 have high development selectivity, the mold 23 and the second dry film 31 may be developed separately. When the mold 23 and the second dry film 31 have low development selectivity, simultaneous development of them is preferred from the standpoint of productivity.

In the above Example, the liquid ejection head 1 having the constitution shown in FIGS. 1A and 1B and FIGS. 2A, 2B and 2C was manufactured. For each of the supply paths 5, three columnar members 13 were formed at equal intervals. The diameter of each of the columnar members 13 was 10 μm; a distance from the edge portion 19 of the first opening 7 of the supply path 5 on the side of the ejection orifice 10 to the longitudinal axis of each of the columnar members 13 was 10 μm; and a distance between the longitudinal axes of the columnar members 13 adjacent to each other was 15 μm. The tilt angle A was less than 90 degrees. It was confirmed that the end surface 14 of the columnar member 13 is tilted relative to the top plate 8 in a direction away from the ejection orifice 10. When printing was performed using the liquid ejection head 1 that had finished electrical connection, almost no degradation in printing quality was found over a long period of time. On the other hand, a liquid ejection head of Comparative Example similar to that of the above-described Example with the exception that the end surface 14 of the columnar member 13 was flat was manufactured and it was subjected to similar evaluation. Then, degradation in printing quality was found. Analysis of the head of Comparative Example revealed that the number of foreign matters trapped in a region of the supply path 5 on the side of the ejection orifice 10 was larger in the head of Comparative Example than that in the head of Example.

While the present disclosure has been described with reference to example embodiments, it is to be understood that the disclosure is not limited to the disclosed example embodiments. The scope of the following claims is to be accorded the broadest interpretation so as to encompass all such modifications and equivalent structures and functions.

This application claims the benefit of Japanese Patent Application No. 2018-126575, filed Jul. 3, 2018, which is hereby incorporated by reference herein in its entirety.

What is claimed is:

1. A liquid ejection head, comprising:

a substrate having therethrough a supply path to be supplied with a liquid;

a top plate placed opposite to the substrate, equipped with an ejection orifice for ejecting the liquid, and constituting, between the top plate and the substrate, a flow path communicated with the supply path and the ejection orifice; and a columnar member extending from the top plate to an inside of the supply path through the flow path, wherein an end surface of the columnar member positioned in the supply path is tilted relative to the top plate in a direction away from the ejection orifice.

2. The liquid ejection head according to claim 1, further comprising:

other columnar members extending from the top plate to an inside of the supply path through the flow path, wherein the columnar member and the other columnar members are each placed along a wall surface of the supply path.

3. The liquid ejection head according to claim 1, further comprising:

other columnar members extending from the top plate to an inside of the supply path through the flow path, wherein the columnar member and the other columnar members are placed at equal intervals in two directions orthogonal to each other.

4. The liquid ejection head according to claim 1, wherein a tilt angle of the end surface to a side surface of the columnar member is smaller with an increase in a distance from a center of a flow path cross-section of the supply path.

5. The liquid ejection head according to claim 1, wherein the end surface has a concave surface which is concave toward a wall surface proximate to the columnar member of the supply path.

6. The liquid ejection head according to claim 1, wherein the columnar member is placed at a position close to the ejection orifice relative to a center of a flow path cross-section of the supply path.

7. A liquid ejection head, comprising:

a substrate having therethrough a supply path to be supplied with a liquid;

a top plate placed opposite to the substrate, equipped with an ejection orifice for ejecting the liquid, and constituting, between the top plate and the substrate, a flow path communicated with the supply path and the ejection orifice; and a columnar member extending from the top plate to an inside of the supply path through the flow path, wherein an end surface of the columnar member positioned in the supply path is along a bowl-shaped virtual surface protruding toward the top plate at a center of a flow path cross-section of the supply path.

8. The liquid ejection head according to claim 7, further comprising:

other columnar members extending from the top plate to an inside of the supply path through the flow path, wherein the columnar member and the other columnar members are placed along a wall surface of the supply path.

9. The liquid ejection head according to claim 7, further comprising:

other columnar members extending from the top plate to an inside of the supply path through the flow path, wherein the columnar member and the other columnar members are placed at equal intervals in two directions orthogonal to each other.

10. The liquid ejection head according to claim 7, wherein a tilt angle of the end surface to a side surface of the columnar member is smaller with an increase in a distance from a center of a flow path cross-section of the supply path.

11. The liquid ejection head according to claim 7, wherein the end surface has a concave surface which is concave toward a wall surface proximate to the columnar member of the supply path.

12. The liquid ejection head according to claim 7, wherein the columnar member is placed at a position close to the ejection orifice relative to a center of a flow path cross-section of the supply path.

13. A method of manufacturing a liquid ejection head having a substrate and a top plate equipped with an ejection orifice for ejecting a liquid, wherein a supply path to be supplied with a liquid penetrates the substrate from a first surface to a rear surface of the first surface and the top plate is placed opposite to the first surface of the substrate and constitutes, between the top plate and the substrate, a flow path communicated with the supply path and the ejection orifice; the method comprising:

forming a mold having a photosensitive resin on the first surface of the substrate provided with the supply path;

causing a portion of the mold to sag from an opening in the first surface of the supply path along a wall surface of the supply path and thereby forming a sagging portion that fills the opening of the supply path therewith and sags more deeply at a position closer to the wall surface;

exposing the mold having the sagging portion to light with a predetermined pattern;

forming a layer having a photosensitive resin on the mold exposed to light;

exposing the layer to light with a predetermined pattern; and developing the mold and the layer to form the flow path, form the top plate from the layer and form a columnar member extending from the top plate to an inside of the supply path through the flow path.

14. The method of manufacturing a liquid ejection head according to claim 13, wherein both the mold and the sagging portion are formed by transferring and pressing a dry film onto the first surface of the substrate.

15. The method of manufacturing a liquid ejection head according to claim 14, wherein the dry film is transferred at a temperature equal to or more than a softening point of the dry film.

16. The method of manufacturing a liquid ejection head according to claim 13, wherein the mold and the layer are formed from a negative photosensitive resin.

* * * * *